US009586802B2

(12) United States Patent
Tuyls et al.

(10) Patent No.: US 9,586,802 B2
(45) Date of Patent: Mar. 7, 2017

(54) CORKS FOR USE WITH WIRELESS SPOUTS

(71) Applicant: Automatic Bar Controls, Inc., Vacaville, CA (US)

(72) Inventors: James M. Tuyls, Vacaville, CA (US); Dennis J. Honrine, Vacaville, CA (US); Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 15 days.

(21) Appl. No.: 14/610,021

(22) Filed: Jan. 30, 2015

(65) Prior Publication Data

US 2016/0023804 A1 Jan. 28, 2016

Related U.S. Application Data

(60) Provisional application No. 62/029,782, filed on Jul. 28, 2014.

(51) Int. Cl.
*B65D 25/20* (2006.01)
*B67D 3/00* (2006.01)

(52) U.S. Cl.
CPC ..... *B67D 3/0041* (2013.01); *B67D 3/0051* (2013.01); *B67D 3/0077* (2013.01)

(58) Field of Classification Search
CPC ..... B65D 25/20; B65D 25/48; B65D 47/06; B67D 3/0041; B67D 3/0051; B67D 3/0077
USPC ..... 222/566, 567
See application file for complete search history.

(56) References Cited

U.S. PATENT DOCUMENTS 2,642,207 A * 6/1953 Renzi ..... B65D 47/06 215/309
2,727,644 A * 12/1955 Giannos ..... B65D 47/06 222/400.7
3,235,133 A * 2/1966 Zimmerman ..... B65D 47/06 222/189.06
3,422,998 A * 1/1969 Murray ..... B65D 47/06 222/481
3,434,636 A * 3/1969 Kachman ..... G01F 11/263 222/476
3,592,245 A * 7/1971 Schneller ..... B65D 47/06 141/114
3,630,419 A * 12/1971 Pierce ..... B65D 47/32 222/478
3,966,099 A * 6/1976 Sanford, Jr. ..... B67D 3/0051 222/478
D261,212 S * 10/1981 Mills ..... D7/700
5,044,521 A * 9/1991 Peckels ..... B67D 3/0051 215/329
5,211,318 A * 5/1993 Govatzidakis ..... B65D 47/06 222/479
5,397,027 A * 3/1995 Koch ..... G01F 11/262 222/1

(Continued)

*Primary Examiner* — Nicholas J Weiss
(74) *Attorney, Agent, or Firm* — Kilpatrick Townsend & Stockton LLP

(57) ABSTRACT

Embodiments of the present invention provide corks and cork systems that find particular use in connection with wireless spouts used for monitoring the amount of liquid poured from liquid containers. It is desirable to be able to use a wireless spout with various differently-sized bottle. Accordingly, the cork features provided can ease removal and replacement of the wireless spouts onto and off of variously sized bottles, and allow the same spout to be re-used with a differently sized bottle.

7 Claims, 16 Drawing Sheets

(56) References Cited

U.S. PATENT DOCUMENTS

| | | | | |
|---|---|---|---|---|
| 6,230,944 | B1 * | 5/2001 | Castellano | B65D 47/243 222/481.5 |
| D465,387 | S * | 11/2002 | DuBow | D7/700 |
| 7,527,180 | B2 * | 5/2009 | Allen | B65D 47/06 222/481.5 |
| 7,806,303 | B1 * | 10/2010 | Hastings | B65D 47/243 222/481.5 |
| D688,127 | S * | 8/2013 | Agassi | D9/440 |
| 8,657,157 | B2 * | 2/2014 | Blinn | B65D 51/1611 222/1 |
| D708,945 | S * | 7/2014 | Jetmar | D9/439 |
| D732,955 | S * | 6/2015 | Peckels | D9/440 |
| 2005/0194402 | A1 * | 9/2005 | Morrison | B65D 51/248 222/113 |
| 2009/0108022 | A1 * | 4/2009 | Huggins | B67D 3/0041 222/153.04 |
| 2012/0181307 | A1 * | 7/2012 | Grosser | B65D 47/06 222/478 |
| 2014/0263405 | A1 * | 9/2014 | Dziuk | C12H 1/16 222/1 |

* cited by examiner

CORKS FOR USE WITH WIRELESS SPOUTS

CROSS REFERENCE TO RELATED APPLICATIONS

This application claims the benefit of U.S. Provisional Application Ser. No. 62/029,782, filed Jul. 28, 2014, titled "Corks for Use with Wireless Spouts," the entire contents of which are hereby incorporated by reference.

FIELD OF THE DISCLOSURE

Embodiments of the present invention relate generally to corks and to cork systems that find particular use in connection with wireless spouts. As background, wireless spouts are used for monitoring the amount of liquid poured from liquid containers. The cork features described herein ease removal and replacement of the wireless spouts onto and off of variously sized bottles, and allow the same spout to be re-used with a differently sized bottle.

BACKGROUND

The amount of liquid dispensed from liquid containers often needs to be monitored for many endeavors today. For instance, the management of establishments has long found it necessary to carefully monitor the relationship between liquor dispensed and receipts by controlling the quantity of liquor dispensed from a specific bottle and recording the sale.

A few systems have been proposed to date for measuring and recording the amount of liquid dispensed from liquid containers. One such system includes a spout that is configured to attach to an opening of a liquid container. This spout also uses a portion-control mechanism to control the desired amount of liquid poured from the liquid container. The spout may use a radio transmitter for emitting signals containing activity information. A receiver receives the transmitted signals, and provides these signals to a computer at the establishment that processes the signals into text for viewing. One particular system for wireless spouts and systems for dispensing is described in co-pending application U.S. Ser. No. 13/227,408, now published as U.S. Publication No. 2012/0211516. The corks provided herein may find particular use with the spouts described in that application.

BRIEF SUMMARY

Embodiments described herein thus provide corks and cork systems that find particular use in connection with wireless spouts used for monitoring the amount of liquid poured from liquid containers. It is desirable to use a wireless spout with various differently-sized bottles. Accordingly, the cork features described herein are provided in various sizes that can all cooperate with wireless spouts in order to ease removal and replacement of the wireless spouts onto and off of variously sized bottles, and allow the same spout to be re-used with a differently sized bottle.

Certain embodiments provide a cork system for use in securing a wireless spout to a bottle that includes a plurality of hollow cork bodies that have an internal diameter and varying external diameters; the internal diameter of each of the cork bodies has one or more thread receiving portions, and the outer portion of the corks have one or more outer securement features for securing the cork in place in a bottle. The wireless spout has a threaded inlet tube that extends from the spout. In use, the one or more thread receiving portions on the internal diameter of the cork may be screwed onto the threaded inlet tube of the wireless spout. It should be understood that other connection systems are possible and within the scope of this disclosure, as outlined below. The plurality of corks may be provided as a kit that allows the user to select an appropriately-sized cork that fits the bottle to which the wireless spout is to be secured.

Certain embodiments also provide a way to stabilize a cork with respect to a wireless spout, using cooperation between the spout breather tube and projections on the cork as a cork anti-rotation feature. This can help prevent the cork from separating from the spout during the twisting used to remove the cork/spout combination from a bottle.

Certain embodiments further provide features that allow a cork core to be configured to fit into wide-mouthed bottles. The features are designed to provide an activating disc that can activate the bottle sensor switch that would not otherwise contact a wide-mouthed bottle.

Certain embodiments also provide a method for re-using a spout for registering and tracking liquid poured from a bottle, which includes selecting an appropriately sized cork from one of the cork systems described herein; securing the selected cork to the spout by threading the one or more thread receiving portions to a threaded tube of the wireless spout, and inserting the spout into the bottle body.

DETAILED DESCRIPTION

Embodiments of the present disclosure relate generally to corks and cork systems that can be used to seal variously-sized bottles. Owners of restaurant and bar establishments may wish to monitor the amount of wine, liquid, or other alcohol that is poured from various bottles in order to track inventory and sales or to otherwise monitor and measure pour size. In some instances, wireless spouts that contain internal tracking and reporting systems may be used. The electronics for such spouts can be expensive, and it is not desirable for an establishment to stock spouts that fit precisely on every type of bottle mouth. Instead, it is preferable for a single spout to use the described interchangeable cork system, so that the proper cork can be selected for the bottle on which the spout is to be mounted.

Figure 1A:
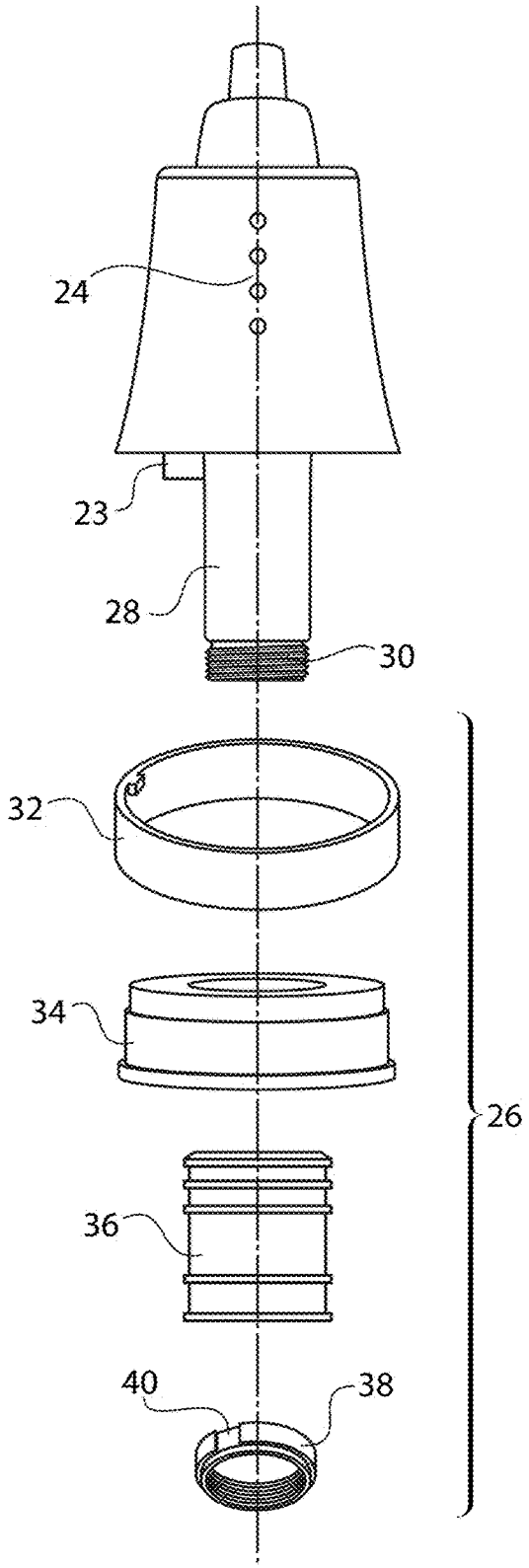
FIG. 1A Prior Art
FIG. 1A shows an exploded view of a wireless spout designed to have a hollow cork secured thereto via a nut.
Figure 1B:
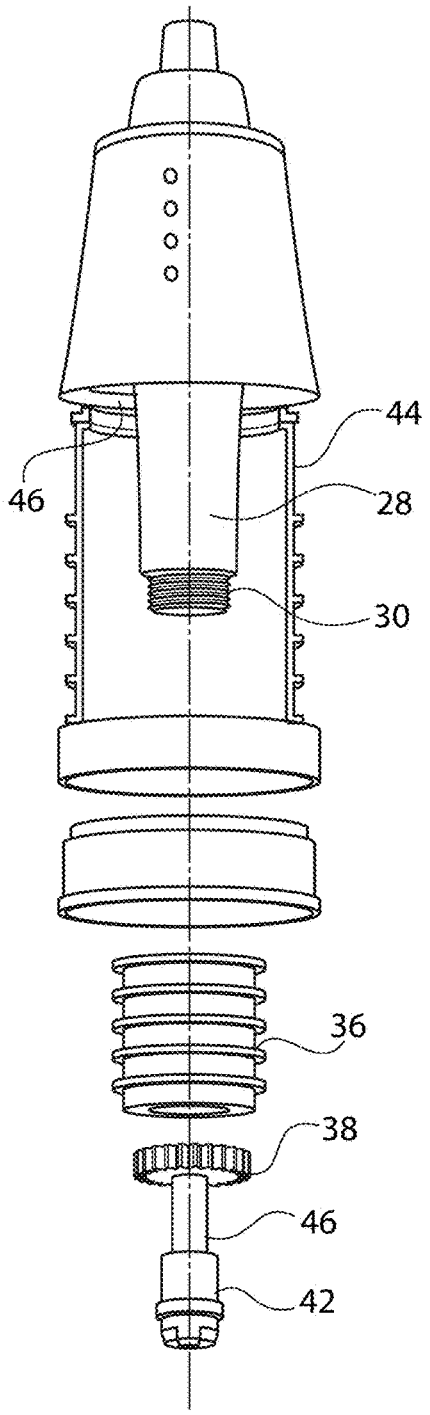
FIG. 1B Prior Art
FIG. 1B shows an exploded view of a wireless spout designed to have a hollow cork secured thereto via a nut. This figure also shows a breather tube for venting, as well as securing straps that may be used to secure the wireless spout to a bottle.

Currently-available options provide a spout housing that is configured to seal an opening of the container. As shown in FIGS. 1A and 1B (reproduced from U.S. Ser. No. 13/227,408), a spout housing 24 may have a conduit 28 extending through the spout housing for liquid passage through the housing. There is also typically an electrically operated valve disposed within the spout housing for selectively clamping the conduit so that a registerable amount of liquid can be dosed. The spout housing may have a threaded spout inlet tube 30 extending from a base of the spout housing. FIGS. 1A and 1B show an attachment system comprising a removable and replaceable cork and nut system 26, wherein the cork 36 is configured to be secured on the threaded spout inlet tube 30 with the nut 38. Although this system provides some definite advantages to cork removability, improvements to this cork system are described herein.

Figure 2:
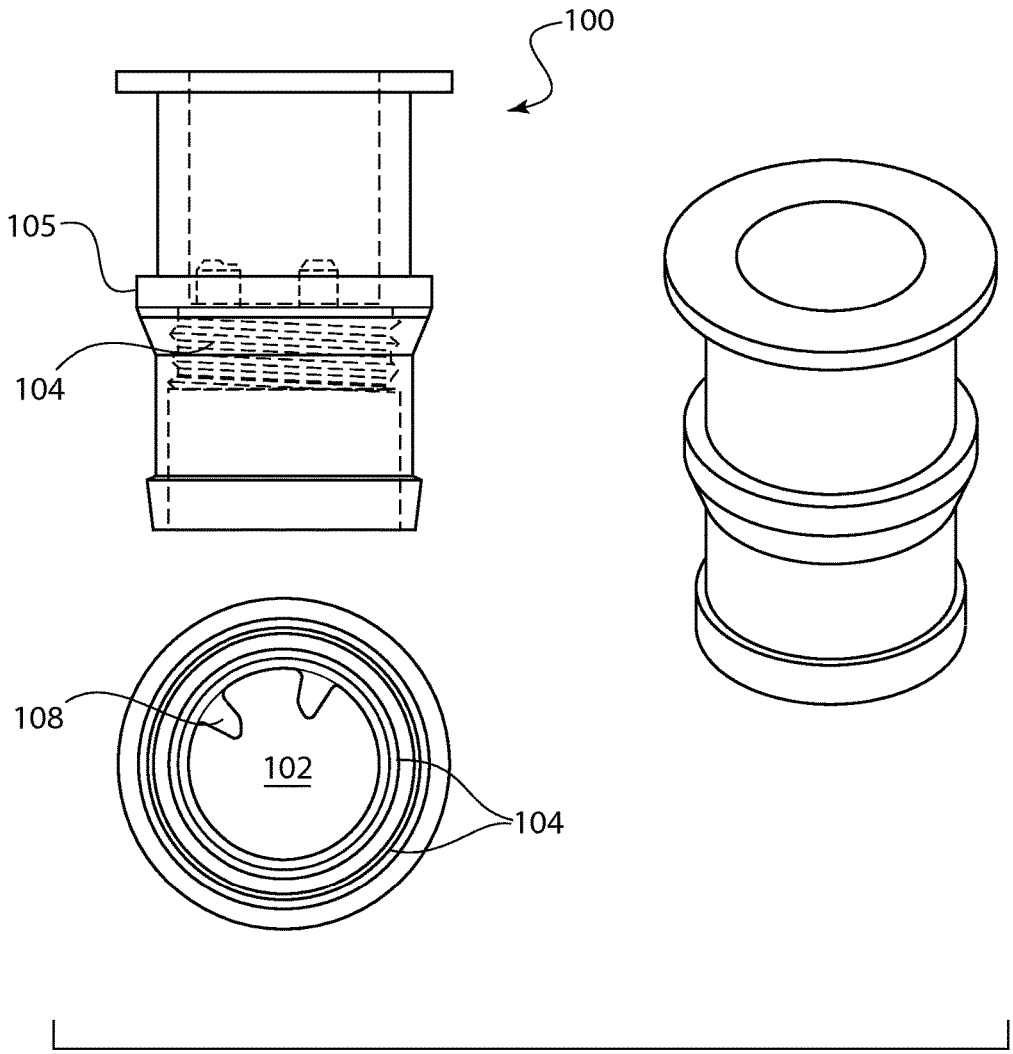
FIG. 2 shows various views of a cork core with an internal diameter having a thread receiving portion according to one embodiment.

As shown in FIG. 2, there is provided a cork core 100. The cork core 100 shown and described is provided as the interior for a family of variously-sized corks, as described below. In one embodiment, a family of corks may be provided as having the same core 100 because they are all designed to cooperate with a universal spout. Rather than being secured against the inlet tube via a nut system 26, the cork core 100 may have an internal diameter 102 with one or more thread receiving portions 104. These thread receiving portions 104 are complementary to the threads on the threaded inlet tube 30 of the spout housing. The thread receiving portions 104 may have any sized pitch, angle, or groove depth and height as desired. They are generally designed to cooperate with whatever sized threads are provided on the threaded inlet tube 30 of the spout housing.

The cork core 100 may be used with one or more separate outer cork portions that are sized for the desired bottle mouth size. For example, a cork core 100 may be used with a large cork outer portion, a medium cork outer portion, or a small cork outer portion. The outer portion may be sized to fit over the cork core 100 portion. For example, the cork core 100 shown in FIG. 2 has an outer securement feature that comprises an external ledge 105. The external ledge 105 may have an upward taper (from the base of the cork to the top of the cork) which can help secure and position an outer cork portion. The upper taper may also be positioned solely on the external ledge, such that it creates a natural stopping point for the outer portion once positioned. This can allow the cork core 100 to provide a modular, interchangeable cork system. A user may select the cork core 100 and then may select an appropriate outer portion to use therewith. The variously sixed outer portions may have outer features similar to those described below.

Figure 3:
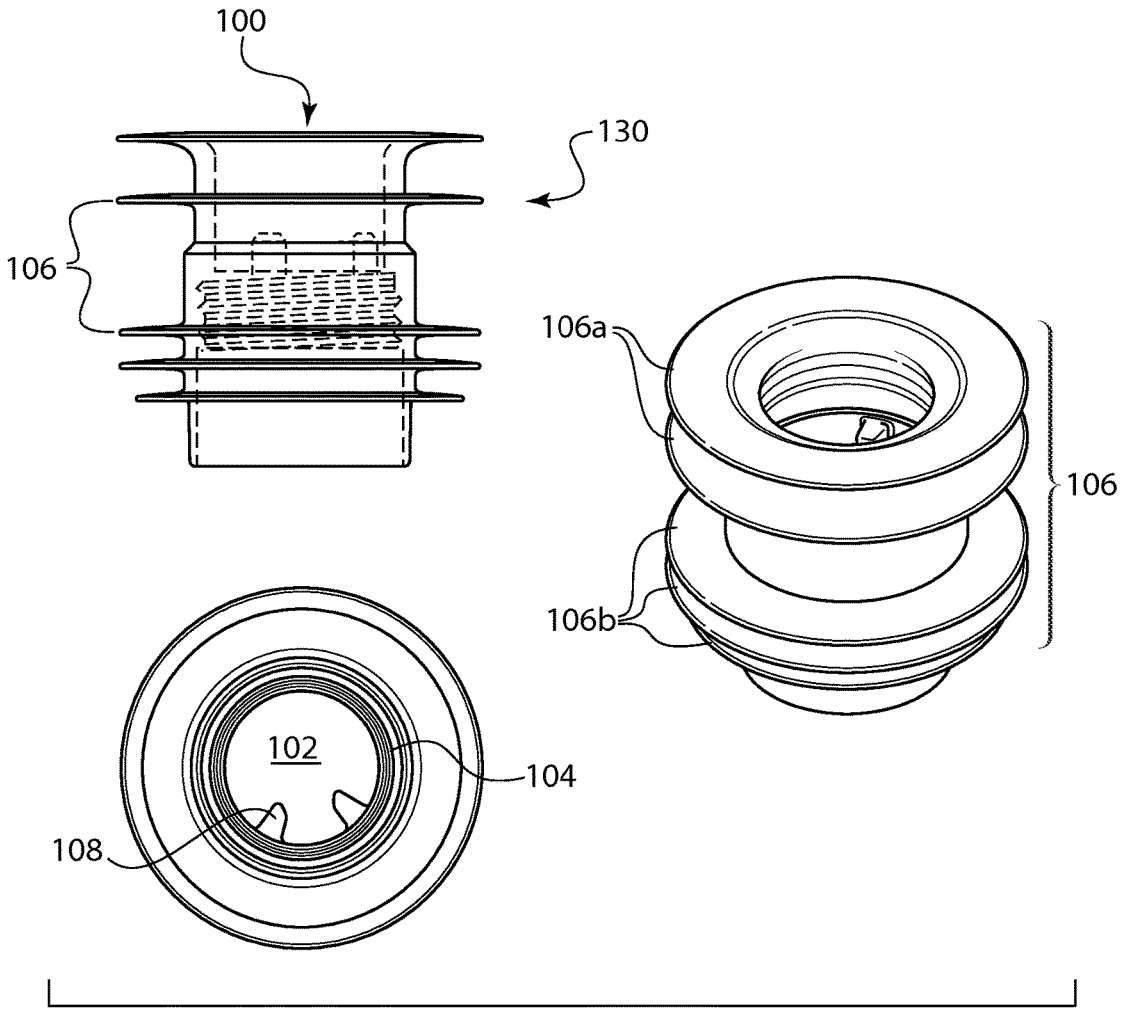
FIG. 3 shows various views of a large cork with an internal diameter having a thread receiving portion and outer circumferential securing rings.
Figure 4:
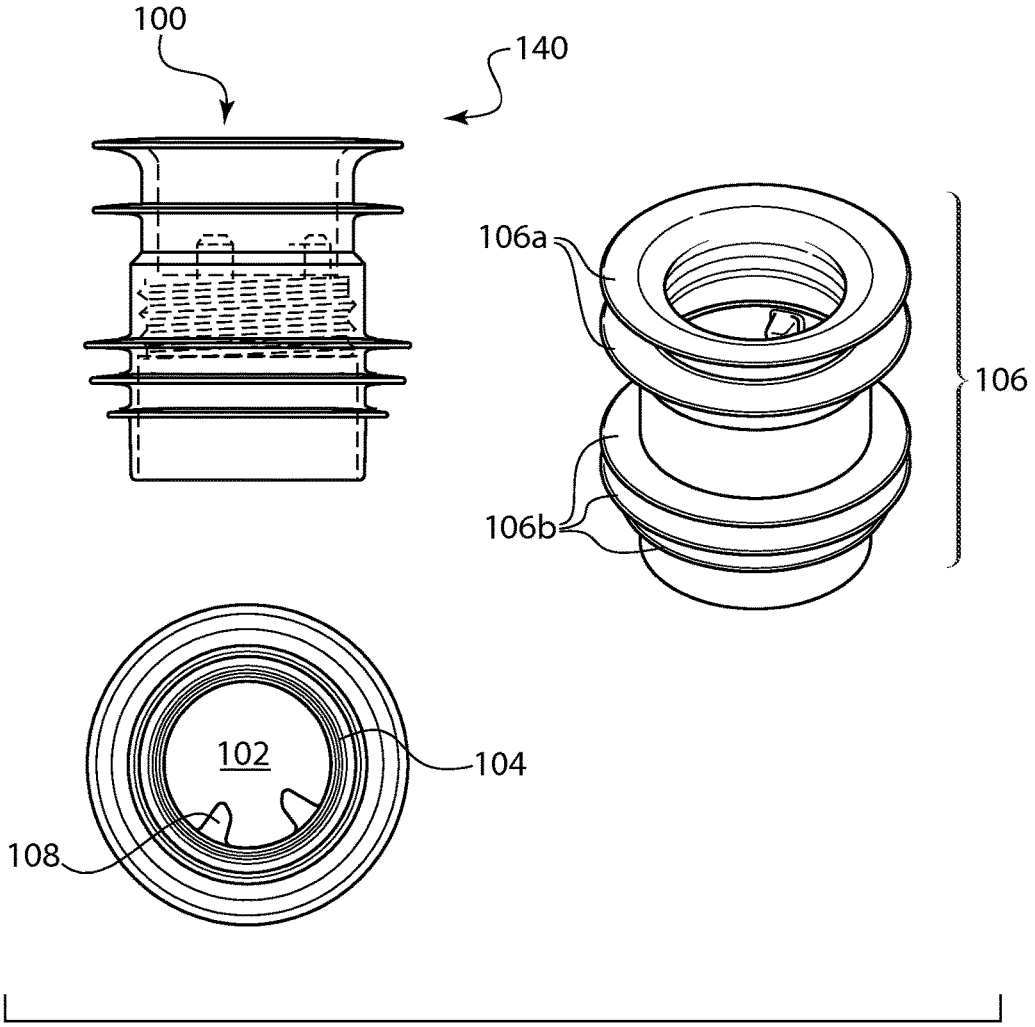
FIG. 4 shows various views of a medium cork with an internal diameter having a thread receiving portion and outer circumferential securing rings.
Figure 5:
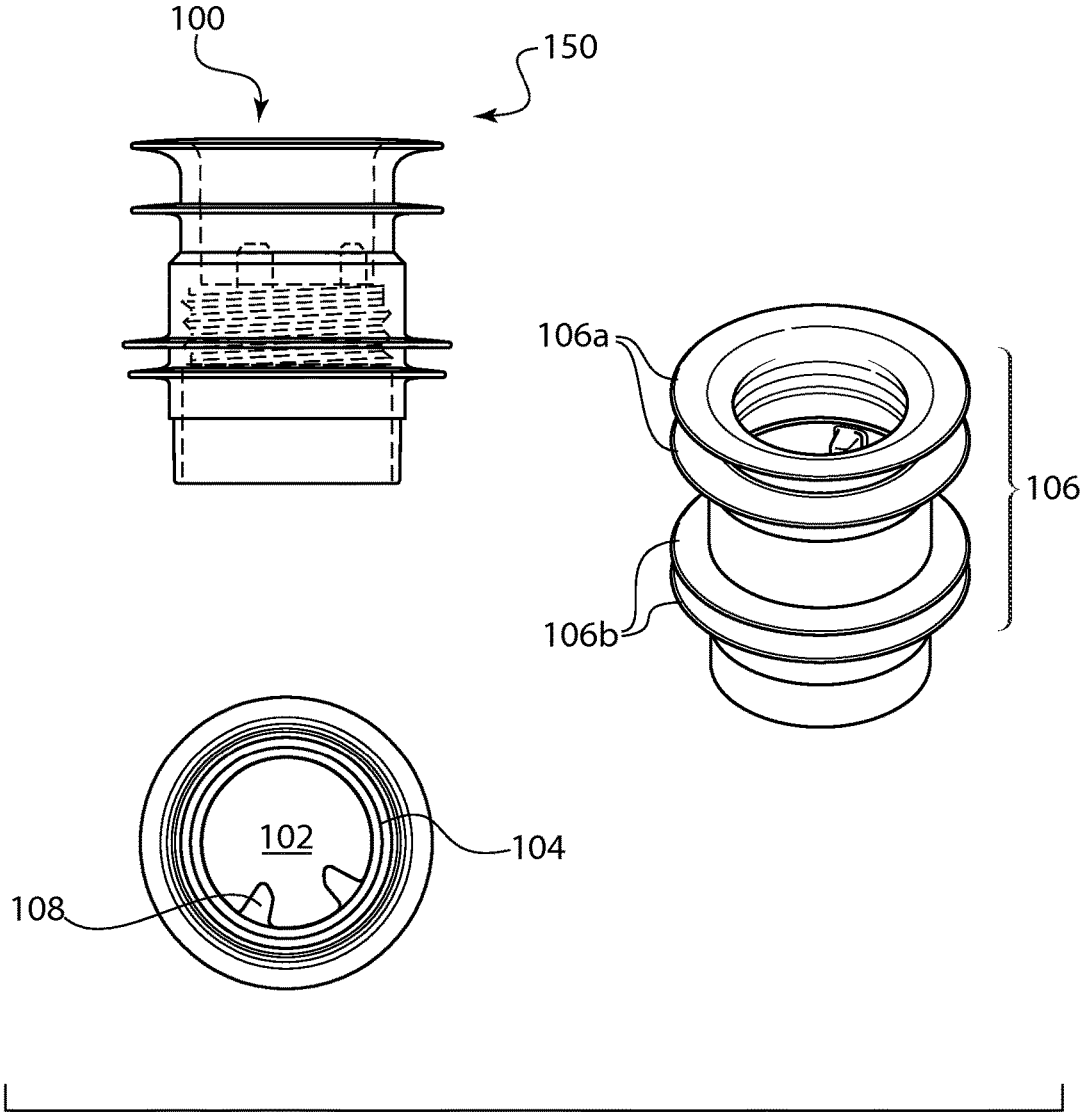
FIG. 5 shows various views of a small cork with an internal diameter having a thread receiving portion and outer circumferential securing rings.

Alternatively, variously-sized corks are provided, all of which have the same inner core shape. This may be instead of providing a modular, interchangeable cork core 100. For example, a family of corks, all of which have the same inner core 100 diameter and features, may have various outer diameter sizes and various outer securing portions for securing with respect to a bottle that are integrally formed onto the cork core 100. In one embodiment, there may be provided a large cork 130, a medium cork 140, and/or a small cork 150. It should be understood that other in-between cork sizes may also be provided. These corks may all have the same cork core features, particularly the internal thread receiving portions 104. The features of various cork sizes are illustrated in FIGS. 3-5 and are described below in more detail. Once the appropriately-sized cork 100, 130, 140, 150 is selected to match the mouth of the bottle to which the spout is to be secured, the user screws the internal thread receiving portions 104 of the cork 100 to the threads of the inlet tube 30.

It should be understood that although internal thread receiving portions 104 are shown and described, alternate mating systems may be used. For example, the corks may have a magnet that cooperates with a corresponding magnetic surface of the spout. In another embodiment, the cork may have an upper surface with a securing protrusion and the spout housing may have a lower surface with a securing recess, such that the two may be locked together at an interface (or vice versa).

In addition to having a similarly-shaped core, the corks 130, 140, 150 have varied outer features that assist with their securement into an appropriately sized bottle. They may be designed having various different outer profile forms so as to provide various different corks with varying outer securement features and sizes. For example, as shown in FIGS. 3-5, the external portions of the cork may have varying outer securement features that comprise outer circumferential rings or ribs 106. Outer circumferential rings 106 can help secure the variously sized corks 130, 140, 150 in a bottle 100. These rings 106 may be positioned anywhere along the outer cork body as desired.

FIG. 3 shows a large cork size 130, which includes two upper rings 106*a* and three lower rings 106*b*. The upper rings 106*a* are designed to abut the bottle opening. The lower rings 106*b* are designed to become trapped and/or wedged against the circumferences of the bottle neck to prevent the flow of air and/or liquid past the rings 106. The outer rings 106 may be provided in staggered and varying sizes. Depending upon the bottle size, one of the lower rings may wedge against the inner diameter of the bottle in order to obtain a sealing engagement/interference fit with the bottle.

FIG. 4 shows a medium cork size 140, which includes two upper rings 106*a* and three lower rings 106*b*. The small cork 150 shown in FIG. 5 has two upper rings 106*a* and two lower rings 106*b*. These images are provided simply to show that any size of cork may be provided (and options other than large, medium, and small may be provided) with any combination of outer circumferential rings thereon. It should be understood that more or fewer external rings 106 (either upper rings 106*a* or lower rings 106*b*) may be provided. In one embodiment, each of the cork sizes 130, 140, 150 has a similarly-shaped internal diameter 102, such that any cork 130, 140, 150 may be used with the same spout housing.

Figure 6:
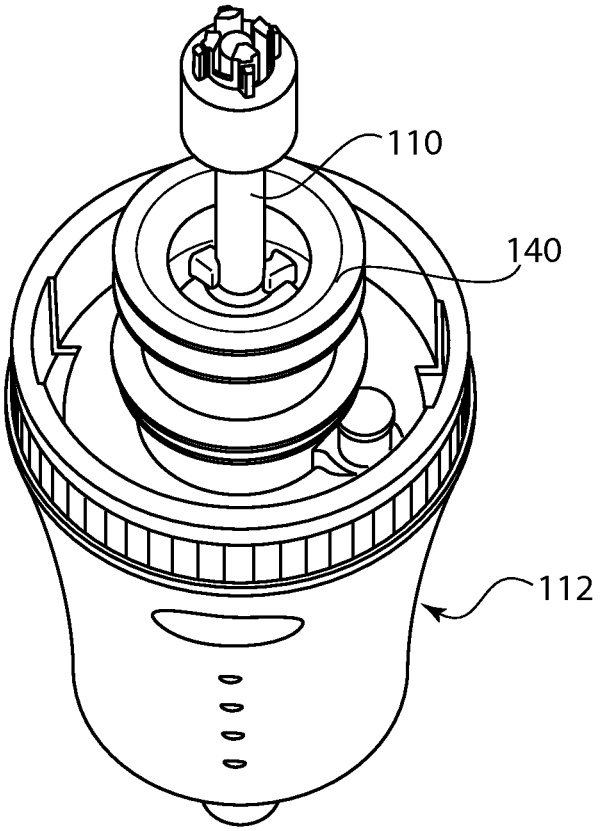
FIG. 6 shows a bottom perspective view of a wireless spout, breather tube, and a cork in an assembled configuration.
Figure 7:
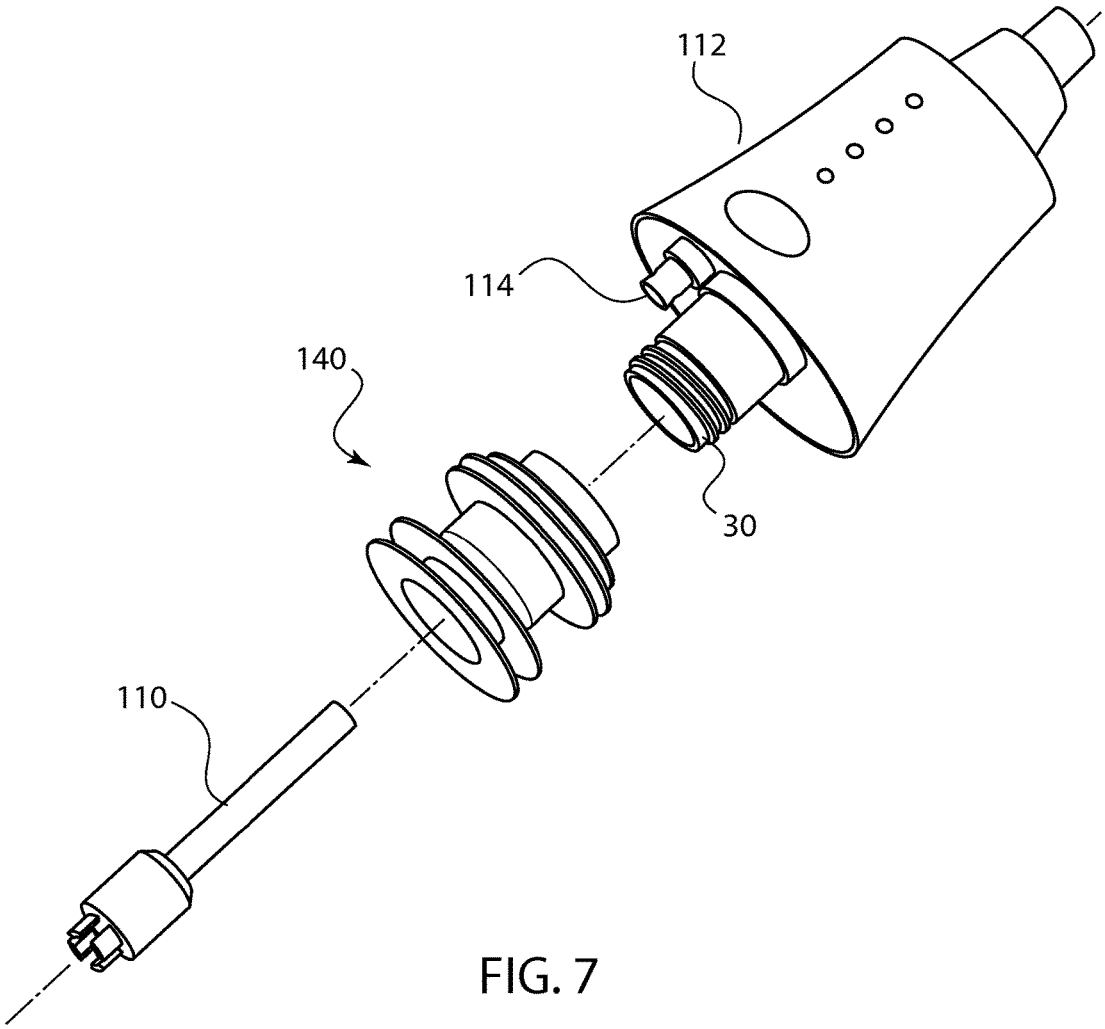
FIG. 7 shows a side perspective view of the assembly of FIG. 6 in an exploded configuration.

It is desirable to keep the cork body aligned with the spout so that the cork cannot twist off of the spout independently. This can be a particular issue when the cork/spout system is twisted during removal from a bottle. The user may twist the spout only, causing the threaded connection between the spout and the cork to loosen or disconnect. Accordingly, as shown in FIGS. 2-5, the corks described may have one or more cork anti-rotation features. As shown in the Figures, the cork anti-rotation features may be a pair of locating projections 108 along the interior surface 102 of the cork core 100. As background, the spout 112 may be provided with a breather tube 110 for venting purposes, one example of which is shown in FIGS. 6 and 7. The breather tube 110 is typically integrally formed with the spout 112. The breather tube 110 is necessary to control dispensing and metering by allowing air to enter through a different opening than the one used to pour liquid for a smoother pour.

The locating projections 108 along interior surface 102 are designed to provide a space into which the breather tube 110 can be pinned. The locating projections 108 can help prevent the cork core 130, 140, 150 from turning with respect to the breather tube 110 and the spout 112 and subsequently freeing itself. Without such anti-rotation features or projections, it is possible that when twisting the cork/spout combination from a bottle, the internal thread receiving portion 104 of the cork could become unscrewed from the threaded tube 30 of the spout 112 and cause the cork to disengage from the spout 112. There is thus provided a feature that keeps the cork from rotating and disengaging from the threaded spout. The solution provided uses the breather tube 110 (that naturally extends from the spout 112 and is fixed with respect to the spout 112) to help prevent the cork from rotating with respect to the tube 110 and spout 112.

In use, the cork may be screwed onto the spout 112 as described. In this configuration, the breather tube 110 extends through the cork body. The breather tube 110 can then be pinned or press fit into place between the locating projections 108. The projections may be the same material as the cork, such as silicone or other pliable material. They may be made of any other appropriate material. The projections 108 may be formed integrally with the cork 100 or they may be separately secured thereto after manufacture. In other embodiments, the cork anti-rotation features may be provided as arms that extend further into or across the diameter 102 of the cork 100, or they may be smaller than shown. It should be understood that any feature that can stabilize the cork with respect to a spout breather tube 110 may be used.

The cork improvements disclosed allow the thread that was formerly provided on the nut (of FIGS. 1A and 1B) to be incorporated directly into the cork 100, 130, 140, 150, eliminating the need for the nut altogether. It is also advantageous that the threaded feature is no longer provided on a separate component, which is easy to lose. If the nut of the previous system is lost, securement of the cork to the stem is not possible until a replacement part is procured. The embodiments described also allow the threaded tube that extends from the spout to be shortened, lending to material savings and a more elegant look to the spout.

Another challenge that can be experienced when attempting to fit a single spout design on various differently sized bottles is that some manufacturers purposely design bottles that are distinctive and that have mouths and/or necks of different sizes and widths. Accordingly, the corks described herein may be enhanced further in order to work with alternate bottle shapes. As background, FIG. 7 shows a spout 112 that has a bottle presence sensor/switch 114. One benefit of this feature 114 is that it allows the spout system to communicate with a master controller and inform the establishment that the spout is on a bottle, as well as when the spout has been removed from a bottle. Without this feature, the wireless spout may transmit "pouring" data as the spout is moved or inverted, even though it is not in position on a bottle. However, some wider mouth bottles (for example, as provided on some tequila bottles) do not always work adequately with the cork system described above because the sensor/switch 114 does not abut the bottle neck of these bottles in normal use. If the above-described corks are positioned on a wide-mouth bottle, there is a chance that the bottle sensor 114 may not actually contact the bottle. (Even if a seal is obtained, the sensor/switch 114 may not appropriately activated.) The sensor 114 may still be within the inner diameter of the bottle mouth so that it is not contacting the bottle opening or being activated. This would prevent pouring data from being transmitted.

Accordingly, there is provided a cork system that provides a way to retro-fit a cork core so that it can fit bottles of varying mouth sizes. The cork core 100 may provide the primary cork body. The cork body may then be provided with a cork stopper portion 126 and an actuating disc 116. The cork body may be provided along with a kit with varying sizes of cork stopper portions 126 and actuating discs 116. This can allow the system to be more universal, without having to re-tool larger and larger cork sizes as bottle sizes change.

Figure 13:
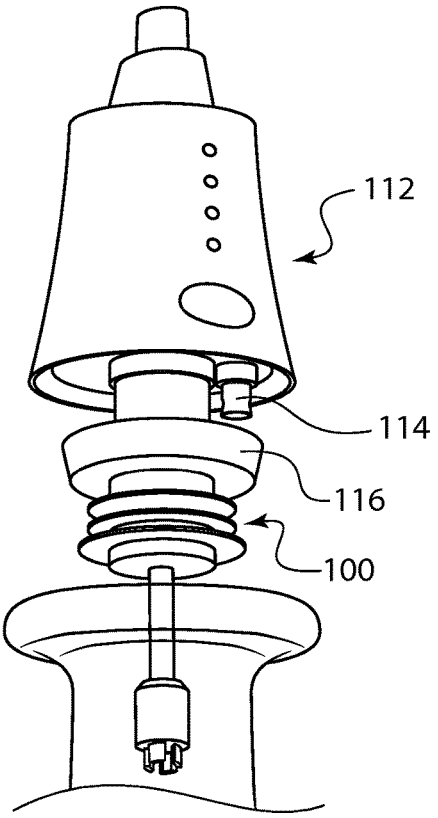
FIG. 13 shows a wireless spout with a cork and an actuating disc in place, prior to being positioned on a bottle.
Figure 14:
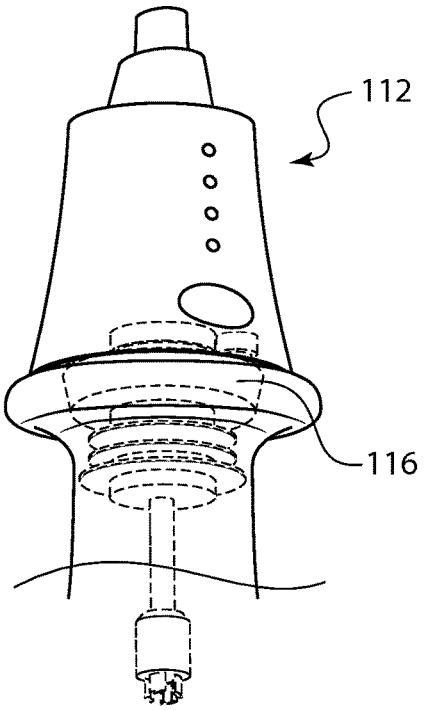
FIG. 14 shows the wireless spout with a cork and an actuating disc of FIG. 13, positioned on a bottle.
Figure 15:
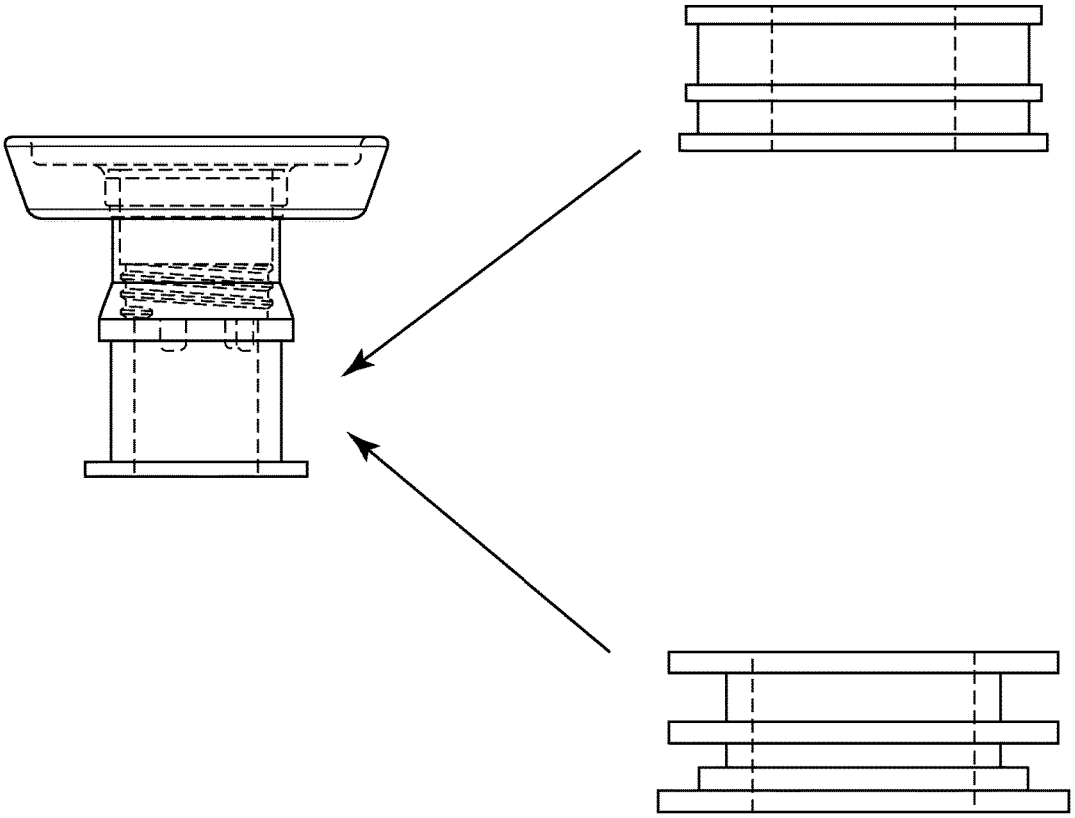
FIG. 15 illustrates a plurality of corks that may be provided as a kit or system for securing a wireless spout to a wide-mouth bottle.

As shown in FIGS. 8-14, the cork core 100 may be provided with an optional actuating disc 116. As shown in FIG. 13, in use, the actuating disc 116 is an element that presses against the sensor/switch 114 when the cork 100 and spout 112 combination is positioned on the wider mouth bottle. As the cork is pressed into the bottle, as shown in FIG. 14, the disc 116 engages the bottle presence sensor/switch 114.

Figure 8:
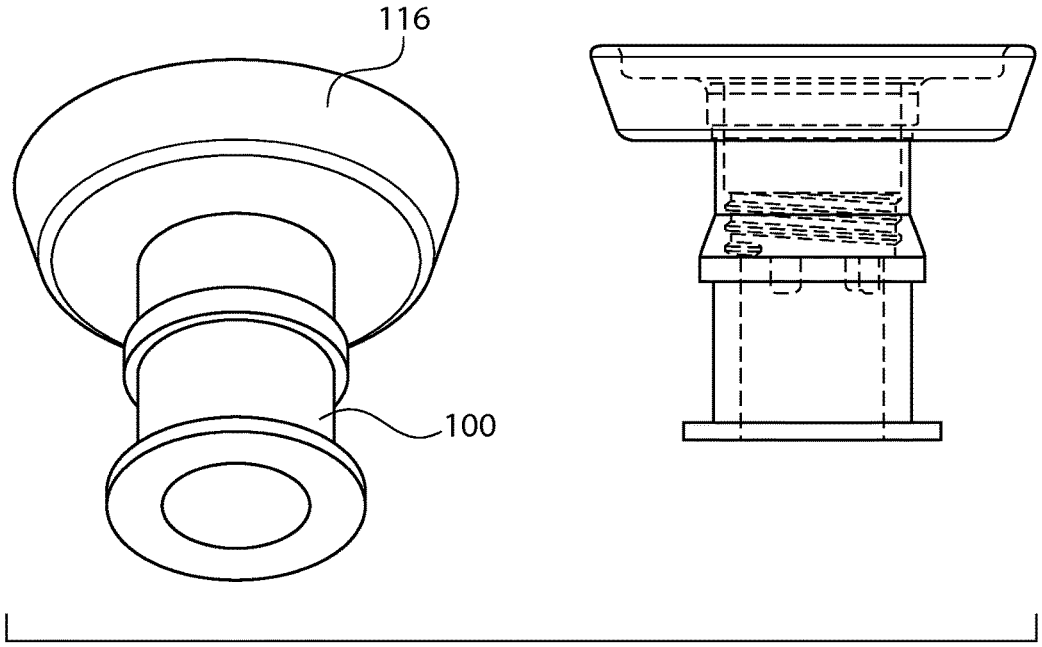
FIG. 8 shows various views of one embodiment of a cork system designed to be used with wider mouth bottles, which includes a cork core and an actuating disc.
Figure 9A:
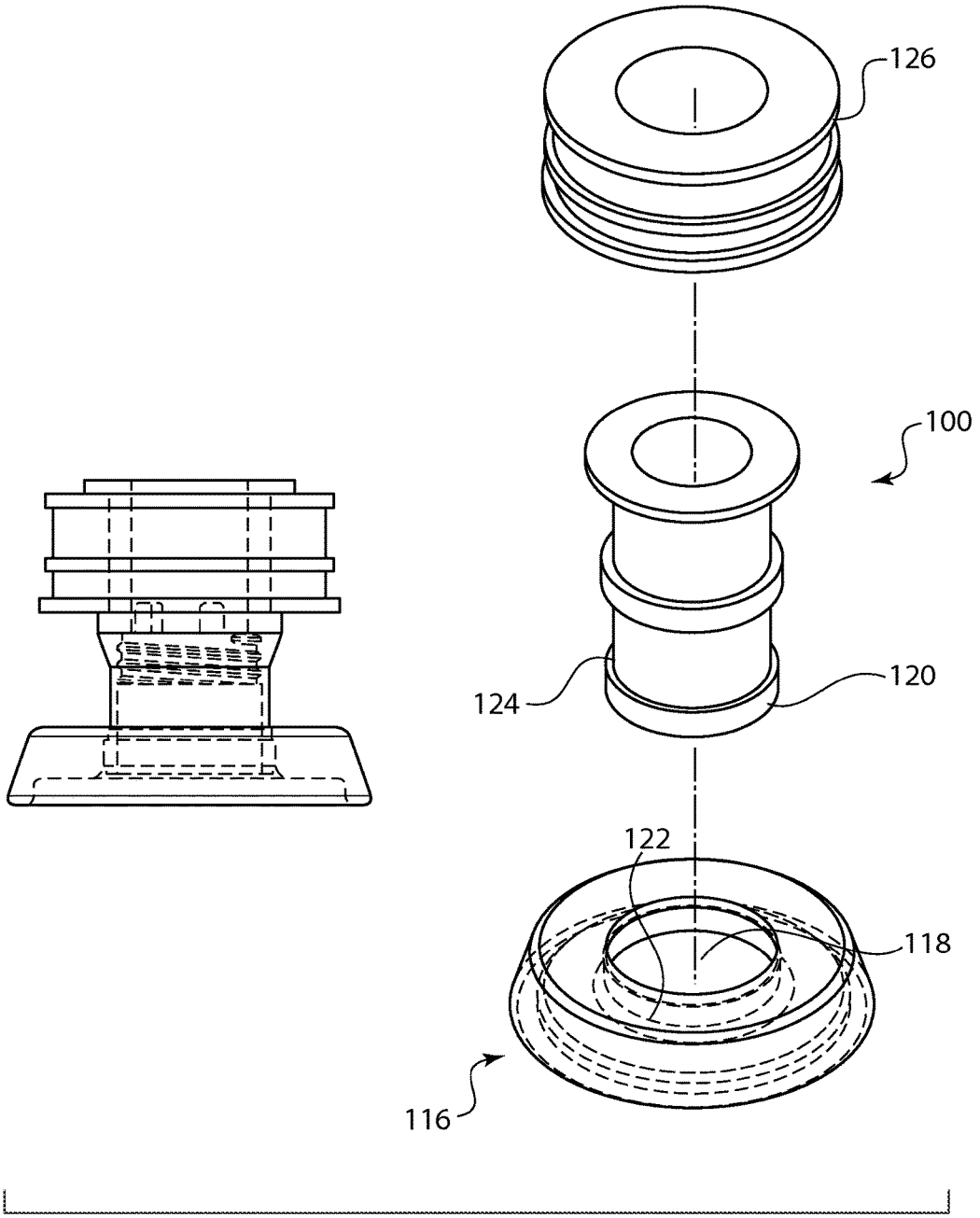
FIG. 9A shows various views of one embodiment of a cork system including an actuating disc and a cork stopper portion that allow the cork system to be used with wider mouth bottles.
Figure 9B:
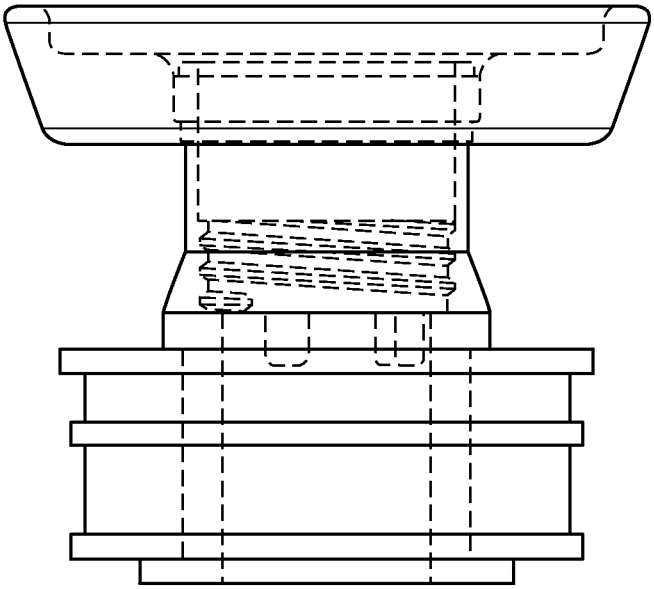
FIG. 9B shows the cork system of FIG. 9A in the orientation it would have when positioned on a wide-mouth bottle.
Figure 10:
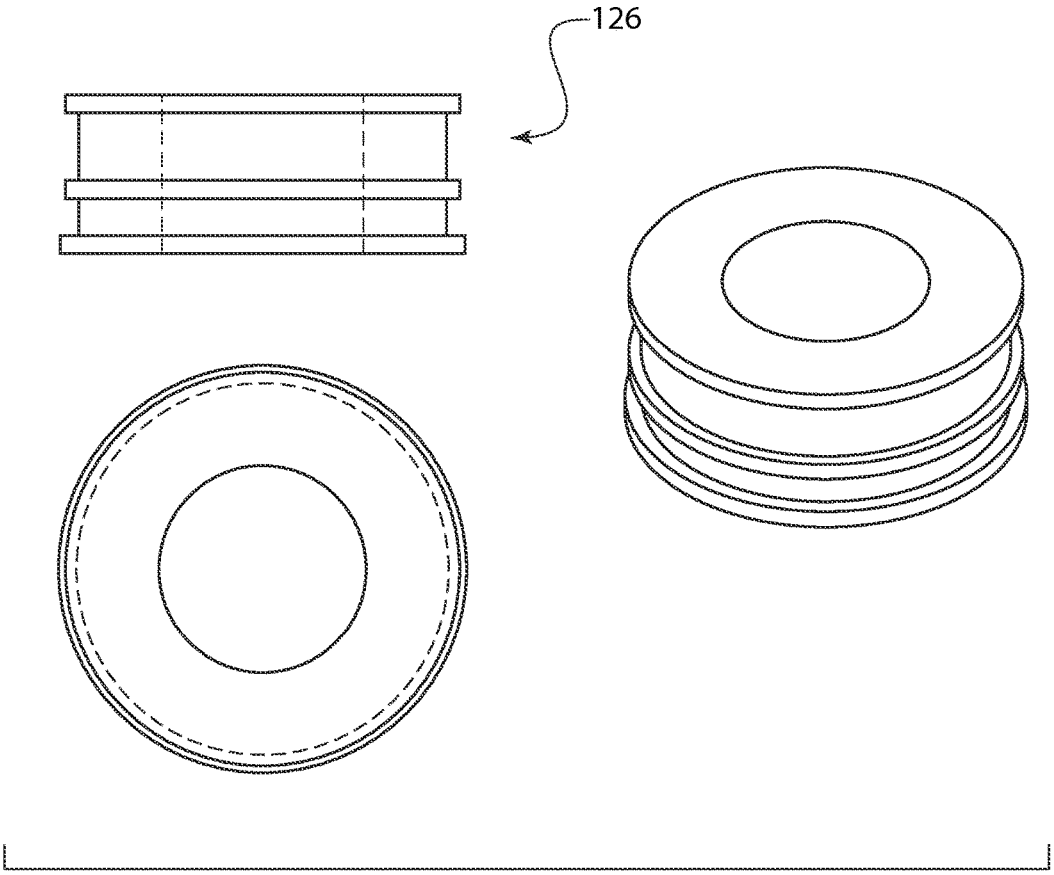
FIG. 10 shows various views of the cork stopper portion for use with the cork system of FIG. 9.
Figure 11A:
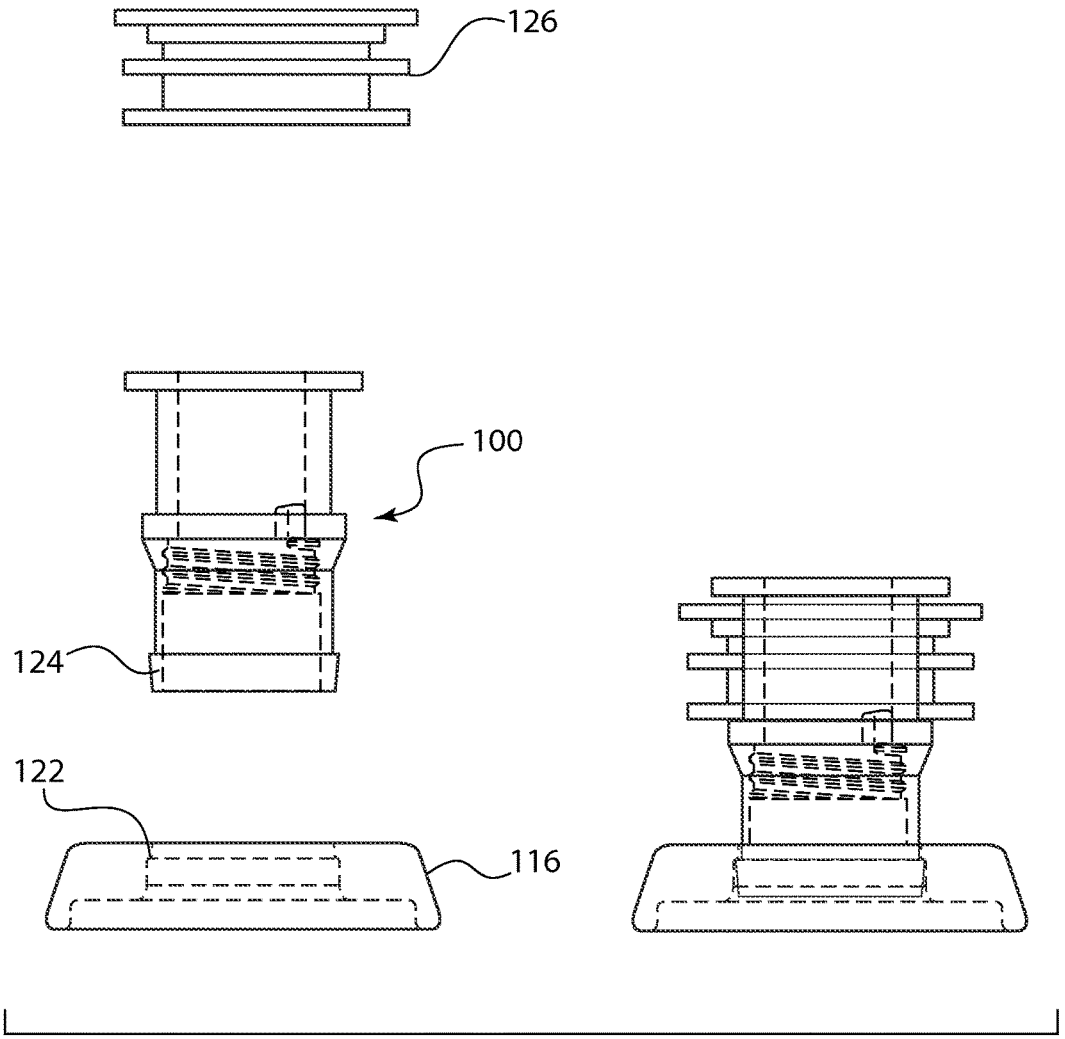
FIG. 11A shows various views of another embodiment of a cork system with an actuating disc and an cork stopper portion that allow the cork system to be used with wider mouth bottles.
Figure 11B:
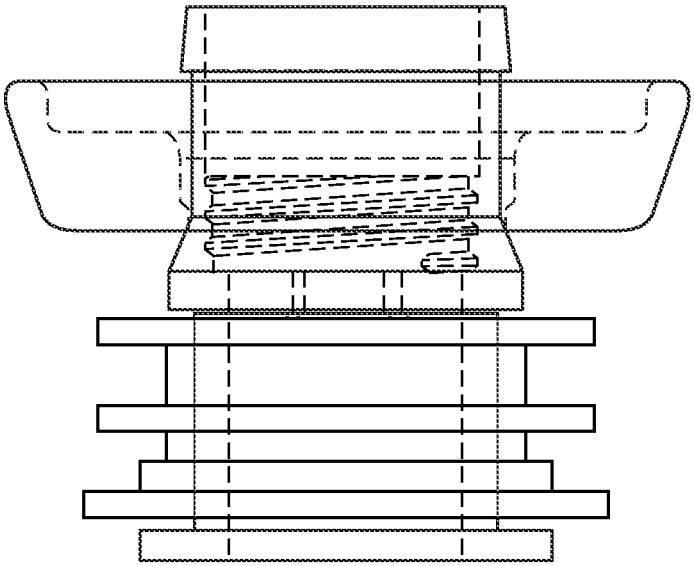
FIG. 11B shows the cork system of FIG. 11A in an orientation it may have prior to being positioned on a bottle.
Figure 11C:
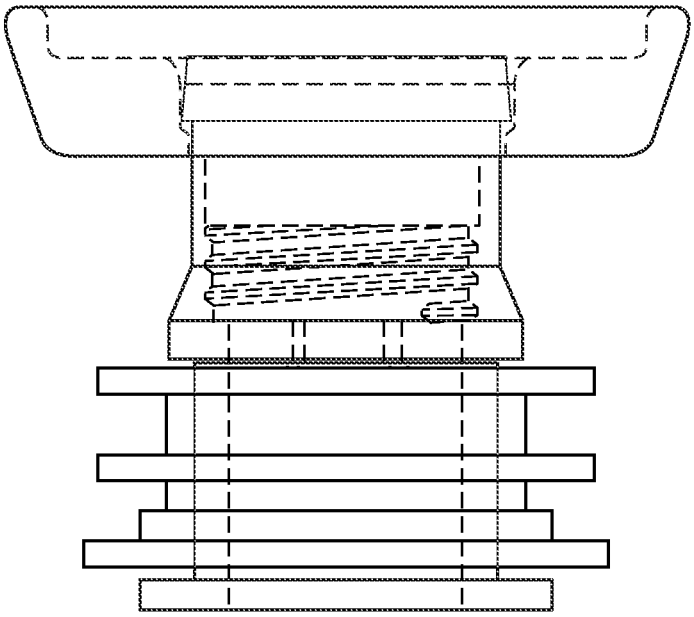
FIG. 11C shows the cork system of FIG. 11A in an orientation it may have while positioned on a bottle, with the actuating disc pressed to its upper most position with respect to the cork core.
Figure 12:
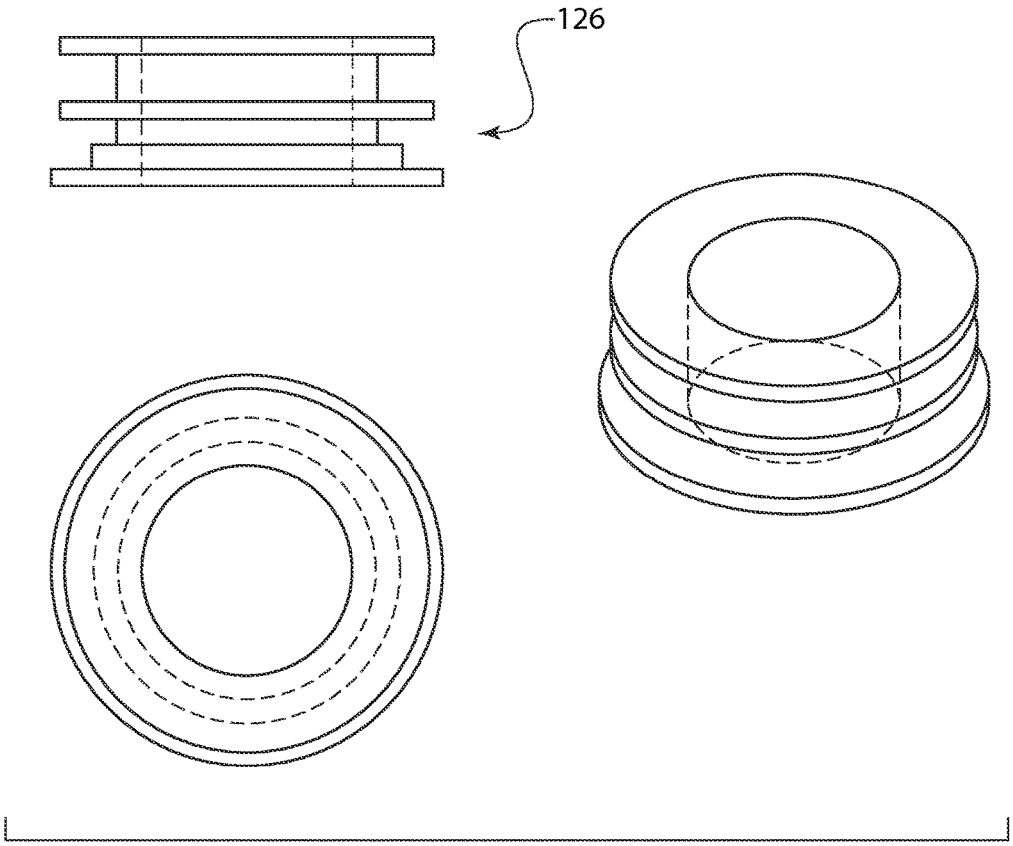
FIG. 12 shows various views of the cork stopper portion for use with the embodiment of FIGS. 11A-C.

FIG. 11C shows an actuating disc 116 in its at-rest position. FIG. 11B shows the actuating disc in its activated position, as it would appear when the system is positioned on a bottle and the actuating disc 116 is depressing the sensor 114 (as shown in FIG. 14). The actuating disc 116 is generally shown as a circular disc, but it should be understood that it may be any desired shape. It may be generally shaped to fit the lower portion of the cork. It may be generally shaped to fit the bottle mouth. It may be provided with an internal opening 118 that corresponds to the shape of the lower base 120 of the cork core 100. The actuating disc 116 may be secured to the cork 100 in any appropriate manner. For example, the actuating disc 116 may have an internal indentation 122 that engages with an external lip 124 at the cork base 120 (or vice versa). Examples of this configuration are shown in FIGS. 8, 9, and 11. The actuating disc may have a smooth inner surface and be caught against a lower ring of the cork core 100 to prevent it from being dislodged from the cork body. In one embodiment, the cork core 100 is made of a hard plastic, and the actuating disc 116 is made of a more flexible rubber material. The rubber can be stretched to cause the actuating disc 116 to fit over the cork core base 120. Any other number of securing options are possible and considered within the scope of this disclosure.

The cork core 100 may be provided with a cork stopper portion 126 that can also be secured to the cork 100 in order to fit the larger bottle mouth. Examples of various embodiments of this feature are shown in FIGS. 9-12. This cork stopper portion 126 may be provided as a separate portion. In another example, the cork stopper portion 126 may be integrally formed with the cork core. In one embodiment, the cork core 100 is made of a hard plastic, and the stopper 126 is made of a more flexible silicone rubber. The silicone rubber can be stretched to cause the stopper 126 to fit over the cork core 100.

The cork core 100, the stopper 126, and the floating disc 116 are designed to allow the system to fit onto any sized bottle. The stopper 126 and floating disc 116 can be provided in varying sizes that can be removed and replaced onto the core 100. It is possible to market the system with a series of these interchangeable components. It is also possible to market the system with the components provided in a pre-assembled configuration, such that the consumer orders the core/stopper/disc combination as a single unit. It is also possible to separately sell replacement parts for the system. The corks in one example of this disclosure may be designed to be removable and replaceable. They may be made of a material that can withstand being pulled from one bottle and then being wedged into the neck of another bottle. The material should also be food-safe and drink-safe. The material should be malleable enough that it can be removed and replaced, but rigid enough that it will not slip or otherwise dislodge from the bottle during pouring. Non-limiting examples of materials that may be used to form the disclosed corks include silicone, polyethylene, synthetic plastics, a plastic/glass combination, any other food/drink-safe plastics, or any other appropriate material. As discussed above, the upper cork/stopper portions 126 may be manufactured from silicone rubber or other flexible material that allows them to be removed and replaced onto the cork core 100.

The corks disclosed herein may be made by any appropriate method of manufacture. For example, there are currently two main production techniques for synthetic bottle closures: injection molding and extrusion (mono-extrusion and co-extrusion). Methods also exist which may combine the two techniques of injection and extrusion. The corks may also be machined. The corks described herein may be formed as solid (i.e., non-hollow) corks with the desired outer diameter and securing features, and may then have the internal diameter with the thread receiving portions bored out. Alternatively, the corks may be formed with the hollow threaded diameter at the outset. It is also possible to form a plurality of cork cores, along with a plurality of differently-sized outer cork portions that cooperate with the cork cores.

Changes and modifications, additions and deletions may be made to the structures and methods recited above and shown in the drawings without departing from the scope or spirit of the disclosure and the following claims.

What is claimed is:

1. A cork system for securing a spout, having a threaded inlet tube and a breather tube extending from the spout, to a bottle, the cork system comprising:

(a) a plurality of hollow corks provided in varying sizes, each of the hollow corks comprising an internal diameter;

(b) the internal diameter of each of the hollow corks comprising (i) one or more thread receiving portions for securement with the threaded inlet tube and (ii) a cork anti-rotation feature comprising locating projections for receiving the breather tube; and (c) one or more outer securement features securing the hollow cork in place in the bottle.

2. The cork system of claim 1, wherein the one or more outer securement features of each hollow cork in the system comprise varied outer features that assist with securement in an appropriately sized bottle.

3. The cork system of claim 1, wherein the one or more outer securement features comprise a series of rings.

4. The cork system of claim 1, wherein the hollow corks comprise a plastic material.

5. The cork system of claim 1, wherein the locating projections comprise protrusions extending from the inner diameter of the hollow cork.

6. A method for re-using a spout for registering and tracking liquid poured from a bottle, comprising:

(a) selecting an appropriately sized cork from the cork system of claim 1 for the bottle;

(b) securing the selected cork to the spout by threading the one or more thread receiving portions to the threaded inlet tube of the spout, and (c) inserting the spout into the bottle body.

7. The method of claim 6, further comprising, between steps (b) and (c), positioning the breather tube within the locating projections.

* * * * *